US005467506A

United States Patent [19]

Nishikawa

[11] Patent Number: 5,467,506

[45] Date of Patent: Nov. 21, 1995

[54] NIPPER APPARATUS FOR USE IN COMBER

[75] Inventor: Shinjirou Nishikawa, Gifu Prefecture, Japan

[73] Assignee: Kabushiki Kaisha Hara Shokki Seisakusho, Gifu Prefecture, Japan

[21] Appl. No.: 338,806

[22] Filed: Nov. 10, 1994

[30] Foreign Application Priority Data

Nov. 12, 1993 [JP] Japan ..... 5-065496 U

[51] Int. Cl.[6] ..... D01G 19/16

[52] U.S. Cl. ..... 19/223; 19/115 R; 19/215

[58] Field of Search ..... 19/115 R, 215, 19/223, 225, 227, 235

[56] References Cited

U.S. PATENT DOCUMENTS 5,001,815 3/1991 Kishi et al. ..... 19/223 X

FOREIGN PATENT DOCUMENTS 11 of 1878 United Kingdom ..... 19/215

*Primary Examiner*—John J. Calvert

*Attorney, Agent, or Firm*—Wenderoth, Lind & Ponack

[57] ABSTRACT

A nipper apparatus for use in a comber has a nipper frame having a cushion plate fixed to a lower portion of the frame. The nipper frame is suspended as a whole by a nipper pivot and a nipper shaft and is arranged to swing toward and away from a detaching roller by a reciprocating turn of the nipper shaft. The nipper apparatus is arranged to repeat gripping and releasing of a fleece on the cushion plate by a nipper knife through motion of a nipper arm having the nipper knife at a front thereof and a spring rod at a rear end thereof which turn according to a swing of the nipper frame. A spring end portion of the spring rod serves as a point for providing pressure support for the nipper arm and is pivotably movably supported with respect to a machine frame. The spring end portion is movable along an arc to a predetermined position according to a change in a nipper gauge and fixable in that position.

3 Claims, 7 Drawing Sheets

NIPPER APPARATUS FOR USE IN COMBER

FIELD OF THE INVENTION

The present invention relates to a nipper apparatus for use in a comber which is arranged so that the timing of the opening and closing of a nipper knife and the swing of a nipper frame can be readily adjusted according to a change of a nipper gauge.

PRIOR ART

First of all, the outline of the construction of a nipper apparatus for a comber will be described below with reference to FIGS. 1 and 4 which are based on the present invention.

A nipper frame 1 is provided with a cushion plate 2 at its bottom and a top comb 3 at its extending end. The front end portion of the nipper frame 1 is suspended from a nipper pivot 6 via a support shaft 4 and a hinge ring 5. The rear end portion of the nipper frame 1 is suspended from a nipper shaft 9 via a support shaft 7 and a nipper lever 8. The nipper frame 1 is arranged to swing, as a whole, toward and away from detaching rollers 10 disposed in the front of the nipper frame 1, in accordance with a reciprocating turn of the nipper shaft 9.

A nipper knife 12 is mounted on the extending end of a nipper arm 11, while spring rods 14 are respectively connected via a support shaft 13 to both end portions of the rear end of the nipper arm 11. The central portion of the nipper arm 11 is turnably supported on the nipper frame 1 via a support shaft 15.

In a prior art nipper apparatus, a spring end portion **14*a* of each of the spring rods 14 is turnably supported directly on a machine frame 16**.

As shown in FIGS. 2 and 3, as the nipper frame 1 moves rearward, the nipper knife 12 which is lifted from the cushion plate 2 moves downward. Then, the nipper frame 1 comes into contact with the cushion plate 2 to grip a fleece 17 which is delivered from the extending end of the cushion plate 2 (refer to FIG. 5). The fleece 17 is combed by cylinder needles **18*a* projectively provided on a combing cylinder 18, owing to a rotation of the combing cylinder 18**.

After the nipper knife 12 has moved down into contact with the cushion plate 2 to grip the fleece 17 therebetween as shown in FIG. 5, the nipper arm 11 is unable to turn with respect to the nipper frame 1. Therefore, a compression spring 19 which is compressively fitted on each of the spring rods 14 is compressed, and the spring rods 14 which serve as a link are reduced in length. (i.e., a gap occurs between an adjustment nut 21 which will be described later and a head **28*a* of a support rod 28 which supports the spring end portion 14*a* of the spring rods 14**).

In combining the fleece 17 in the above-described manner, the operation of changing the noil percentage of a short fiber of the fleece to be spun is carried out in the comber according to the use of spun fiber.

To change the noil percentage, as shown in FIG. 6, a distance S between the rear end portion of a back detaching roller **10*a* and the extending end of the cushion plate 2 when the cushion plate 2 is advanced to its forward end (such distance is referred to as the "nipper gauge") is changed, and the length of the fleece to be subjected to a combing action by the cylinder needles 18*a* projectively provided on the combing cylinder 18 is changed with the nipper knife 12 being moved down in contact with the cushion plate 2 to grip the fleece 17** therebetween.

To increase the noil percentage, the nipper gauge is made larger, whereas, to decrease the noil percentage, the nipper gauge is made smaller.

The nipper lever 8, which turnably supports the nipper frame 1 at the rear end portion of the nipper frame 1 of each delivery part, is fixed to the nipper shaft 9 which is common to all the delivery parts. The nipper shaft 9 is fitted into a nipper shaft bracket (not shown) at its end portion, and the nipper shaft bracket is secured to a swing lever bracket (not shown) by a bolt.

The nipper gauge is changed by loosening the bolt which secures both brackets to each other and changing the phases of both brackets.

If the nipper gauge is changed, the nipper knife 12, which is adapted to come into contact with the cushion plate 2 during the backward movement of the nipper frame 1 and grip the fleece 17 to be spun, can no longer grip the fleece 17 when the nipper frame 1 is moved to a predetermined timing position.

For this reason, if the nipper gauge is changed, it is necessary to adjust the timing of the swing of the nipper frame 1 and the opening and closing of the nipper knife 12.

This adjustment is made in the following manner. When the cylinder needle **18*a* with which constitutes the first row of the multiplicity of cylinder needles 18*a* projectively provided on the combing cylinder 18 is positioned below a set timing position of the cushion plate 2, a lock nut 20 disposed at the rear end of the spring rod 14 is loosened to rotate the adjustment nut 21 (as the adjustment nut 21 is rotated clockwise, the nipper knife 12 moves in the opening direction thereof, and as the nipper knife 12 is rotated counterclockwise, the nipper knife 12 moves in the closing direction thereof). When the adjustment nut 21 is rotated up to a position where the nipper knife 12 is brought into contact with the cushion plate 2, the lock nut 20 is tightened. Incidentally, since the gauge of the top comb 3 also changes with the change of the nipper gauge, it is necessary to adjust the gauge of the top comb 3**.

In the current manufacturing system in which flexible manufacture is carried out, the noil percentage needs to be changed very frequently, so that the aforesaid adjustment must be performed frequently. This adjustment operation is extremely troublesome.

The object of the present invention is to make it possible to readily adjust, when the nipper gauge is changed, the timing of the opening and closing of the nipper knife and the swing of the nipper frame without using the adjustment nut disposed at the rear end of the spring rod.

SUMMARY OF THE INVENTION

According to the present invention, there is a nipper apparatus for use in a comber which comprises a nipper frame having a cushion plate fixed to its lower portion, the nipper frame being suspended as a whole by a nipper pivot and a nipper shaft and being arranged to swing toward and away from a detaching roller by a reciprocating turn of the nipper shaft, the nipper apparatus being arranged to repeat gripping and releasing of a fleece on the cushion plate by means of a nipper knife by causing a nipper arm having the nipper knife at its front end and a spring rod at its rear end to turn according to a swing of the nipper frame. In the nipper apparatus, a spring end portion of the spring rod which serves as a point for providing pressure support for the nipper arm is supported movable with respect to a machine frame, and the spring end portion is moved to a predetermined position according to a change in a nipper gauge and refixed in that position.

If it is desired to adjust, according to a change in the nipper gauge, the timing of opening and closing of the nipper knife and the swing of the nipper frame, the spring end portion of the spring rod is made to move slightly with respect to the machine frame without rotating an adjustment nut.

In this manners, the nipper arm slightly turns about its support shaft with respect to the nipper frame, so that the timing of the opening and closing of the nipper knife provided at the front end of the nipper plate and the swing of the nipper frame is adjusted readily and securely.

EMBODIMENTS

Figure 1:
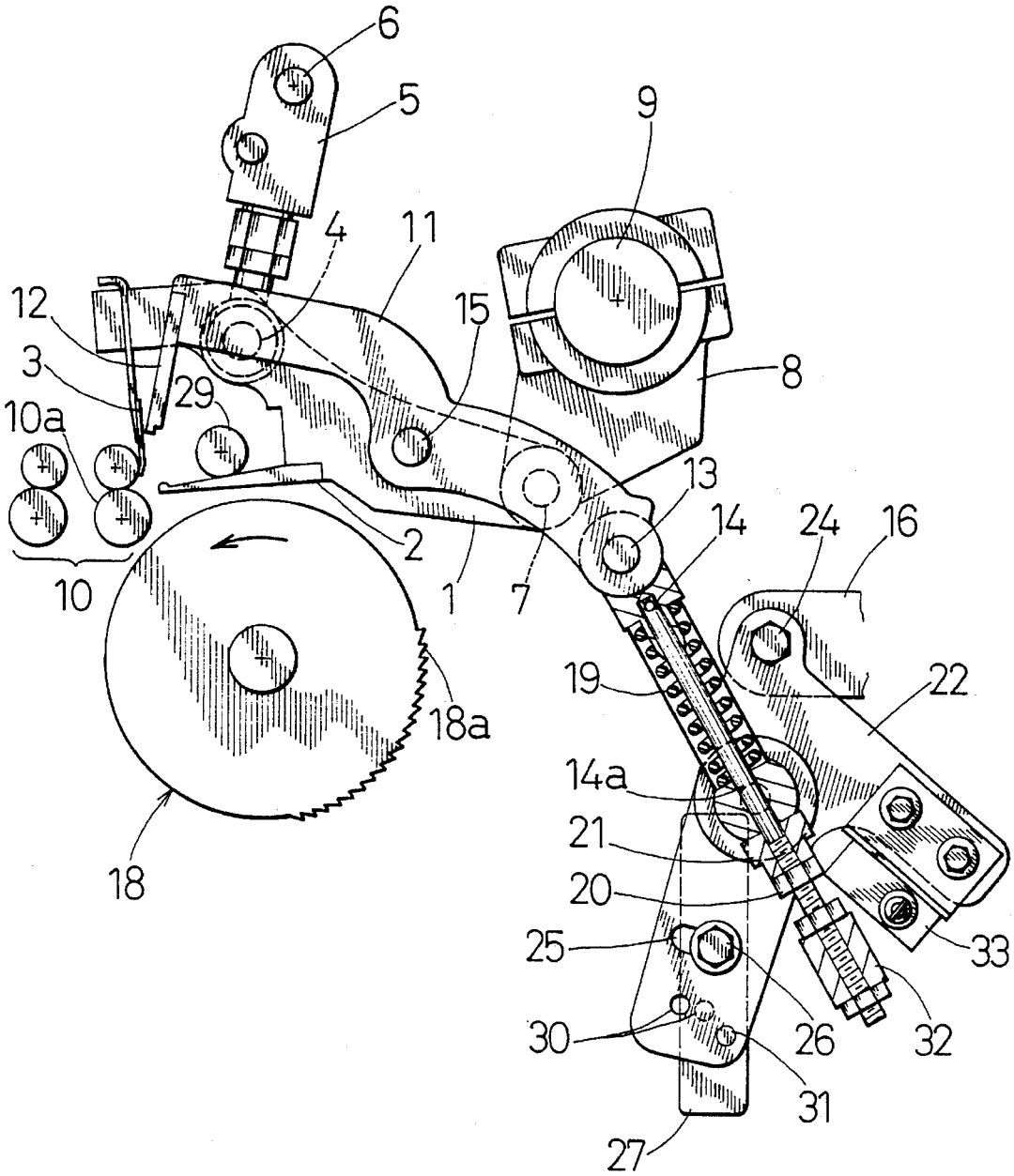
FIG. 1 is a front elevational view of the nipper apparatus in which the nipper frame 1 has reached its forward end.

The present invention will be described below in further detail with reference to an embodiment. In the following description, identical reference numerals are used to denote elements identical to those described above in the section "Prior Art". The description of such identical elements is omitted and only a portion characteristic of the present invention will be described.

The present invention is characterized in that a spring end portion 14*a* of each of the spring rods 14 is supported movable with respect to the machine frame 16. Specifically, as partly shown in FIGS. 1 and 4, a spring end bracket 22 is fitted to the machine frame 16, and the upper end portion of the spring end bracket 22 is supported on the machine frame 16 via a collar 23 and a fixing bolt 24. A fixing bolt 26, which is inserted into a slot 25 formed in the lower portion of the bracket 22, is screwed into a fixing block 27 fixed to the machine frame 16. Accordingly, the spring end bracket 22 can be slightly turned about the fixing bolt 24 provided in the upper end portion, and be fixed at a predetermined position.

Figure 2:
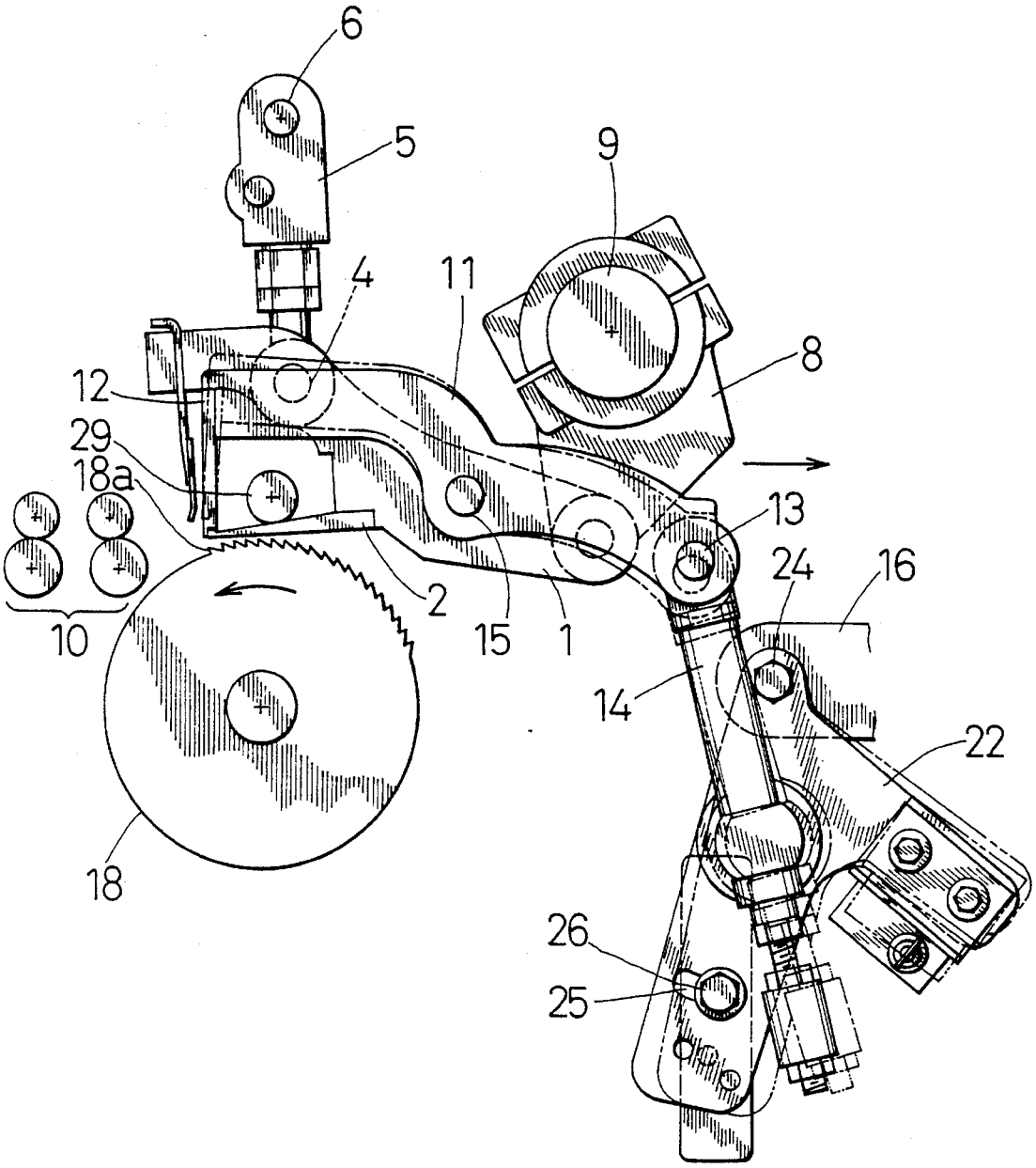
FIG. 2 is a front elevational view of the nipper apparatus in which the nipper knife 12 which has been lifted from the cushion plate 2 is in contact with the cushion plate 2.
Figure 3:
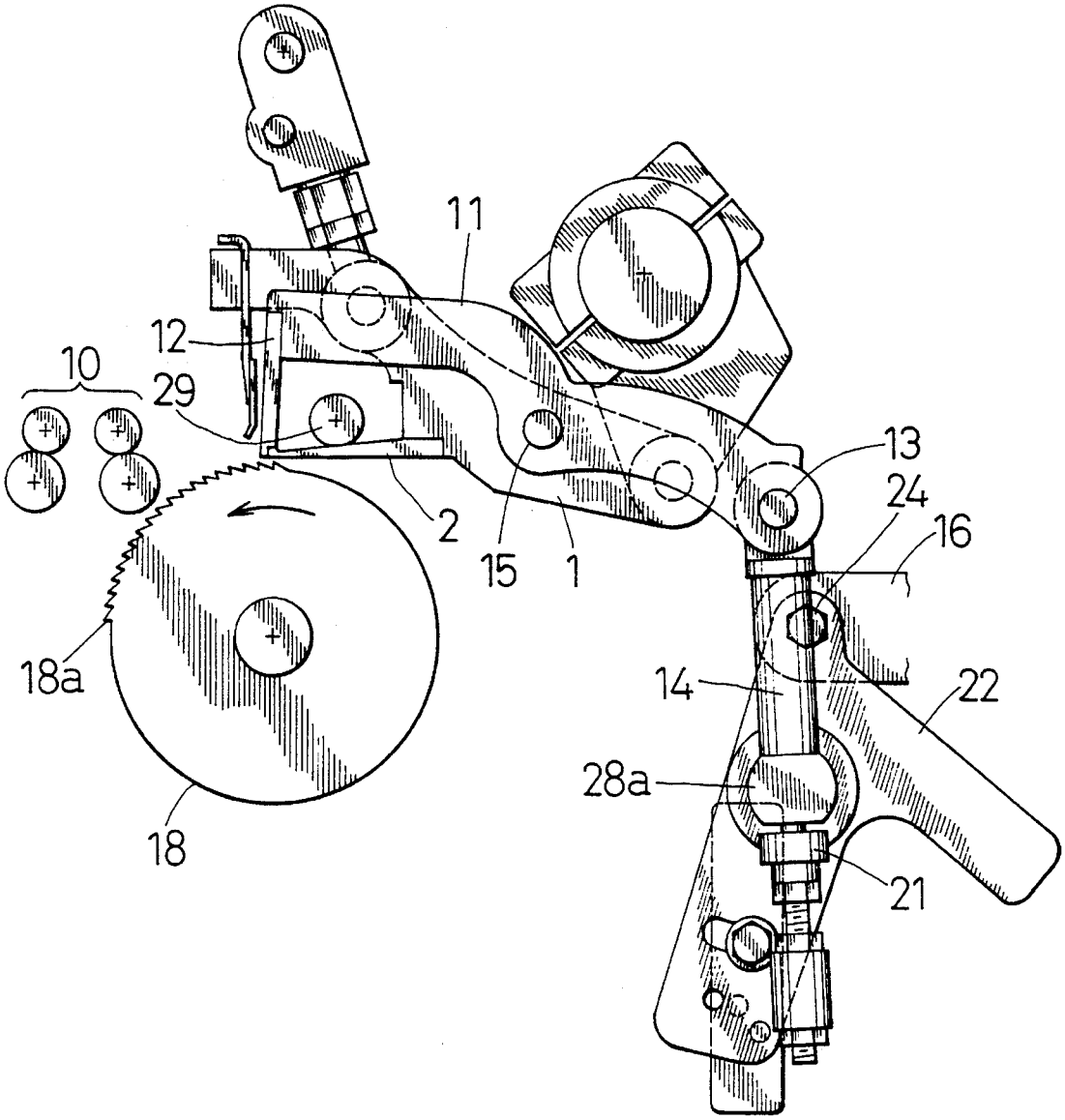
FIG. 3 is a front elevational view of the nipper apparatus in which the nipper frame 1 has reached its rearward end.

The support rod 28 is horizontally supported in a projecting portion 22*a* of the spring end bracket 22, and the spring end portion 14*a* of the spring rod 14 is supported by the head 28*a* of the support rod 28. In FIGS. 1 through 3, reference numeral 29 denotes a feed roller for the fleece 17 provided on the nipper frame 1.

If the nipper gauge is changed, the timing of the opening and closing of the nipper knife 12 and the swing of the nipper frame 1 is adjusted in the following manner.

Figure 7:
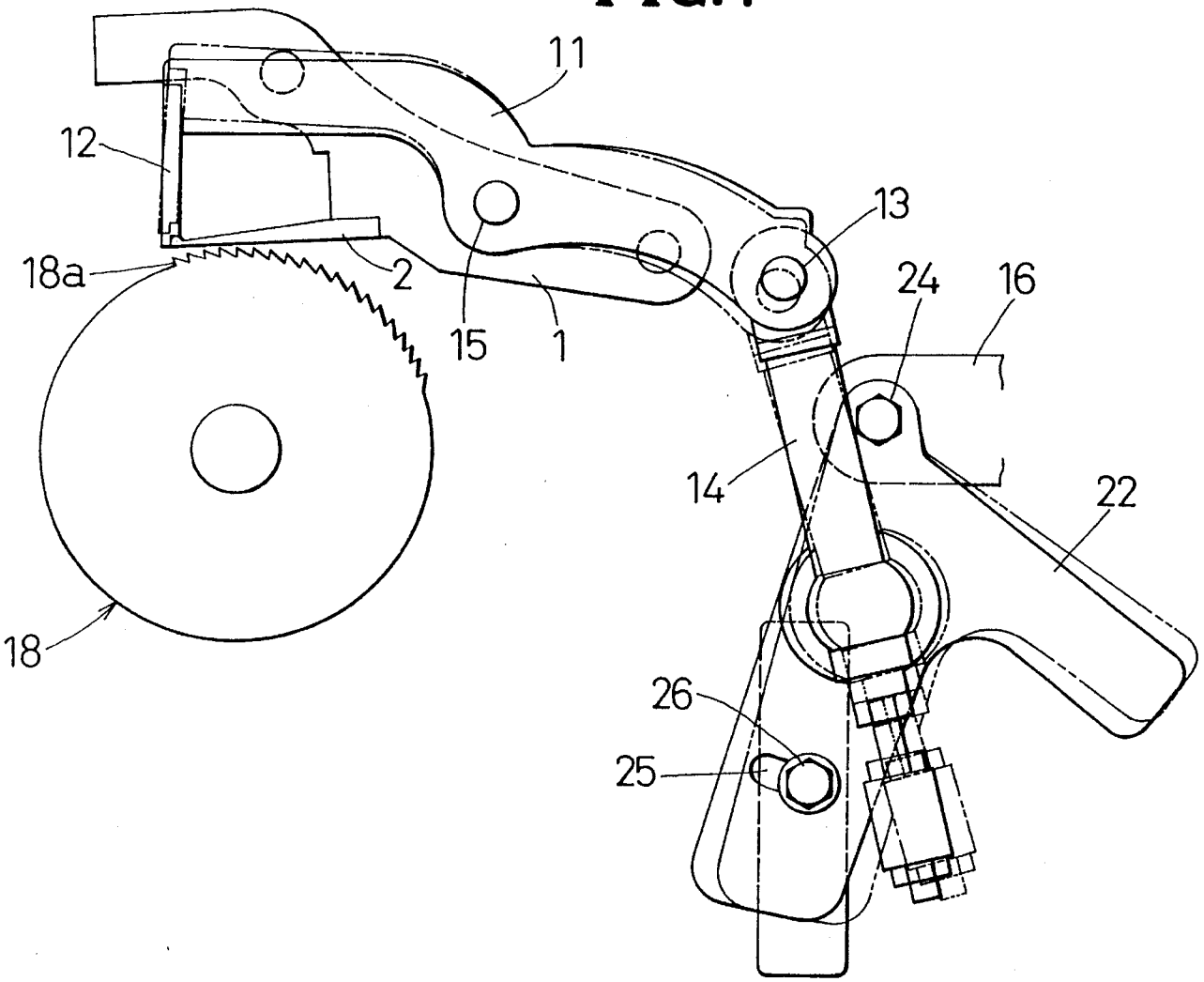
FIG. 7 is an explanatory view of the timing adjustment of the opening and closing of the nipper knife 12 and the swing of the nipper frame 1.

For example, if the nipper guage S is changed, the nipper knife 12 should come into contact with the cushion plate 2 of the nipper frame 1 to grip the fleece 17 at an index (33.5) where the forward end of the cushion plate 2 is positioned approximately immediately above the cylinder needle 18*a* which constitutes the first row of the cylinder needles 18*a* projectively provided on the combing cylinder 18. However, if the nipper knife 12 moves out of contact with the cushion plate 2 as shown by a two-dash chain line in each of FIGS. 2 and 7, both the fixing bolt 24 about which to turn the spring end bracket 22 and the fixing bolt 26 which is inserted into the slot 25 in the spring end bracket 22 are loosened and the spring end bracket 22 is turned in the direction indicated by a solid line in each of FIGS. 2 and 7. Then, the fixing bolts 24 and 26 are again tightened to fix the spring end bracket 22 to the machine frame 16.

In the above-described manner, by turning the spring end bracket 22 about the upper end portion thereof, the spring end portion 14*a* of the spring rods 14 is slightly moved to turn the nipper arm 11 about the support shaft 15, whereby the timing of the opening and closing of the nipper knife 12 is adjusted.

In almost all cases, the nipper gauge can be adjusted by moving the spring end bracket 22. If the nipper apparatus is to be used under a particular condition, such as a case where it is desired to increase the amount of opening of the nipper knife 12, both the turn of the spring end bracket 22 and the rotation of the adjustment nut 21 can be used to meet that condition.

In addition, a plurality of pinholes 30 are formed in the spring end bracket 22 to cope with particular nipper gauges requiring a highly frequent noil percentages selection. If any one of the particular noil percentages is selected, a pin 31 is inserted into the one of the pinholes 30 which corresponds to the selected, particular noil percentage, thereby fixing the spring end bracket 22 to the machine frame 16. Thus, it is possible to quickly perform the aforesaid adjustment.

Means for moving the spring end portion 14*a* of the spring rods 14 is not limited to the arrangement of the above-described embodiment which employs the spring end bracket 22.

Figure 4:
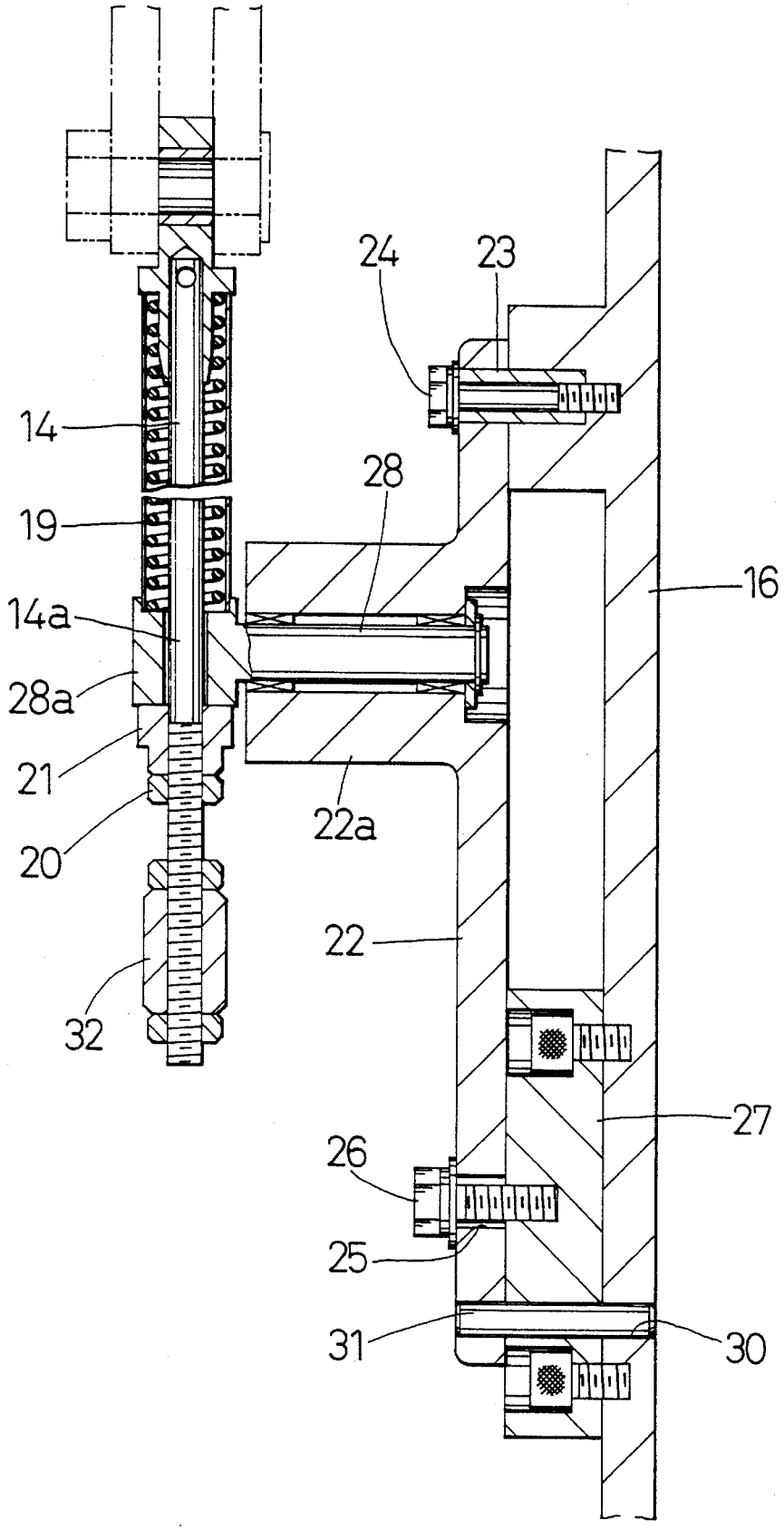
FIG. 4 is a cross-sectional view of a portion in which a spring end bracket 22 is fixed to the machine frame 16.
Figure 5:
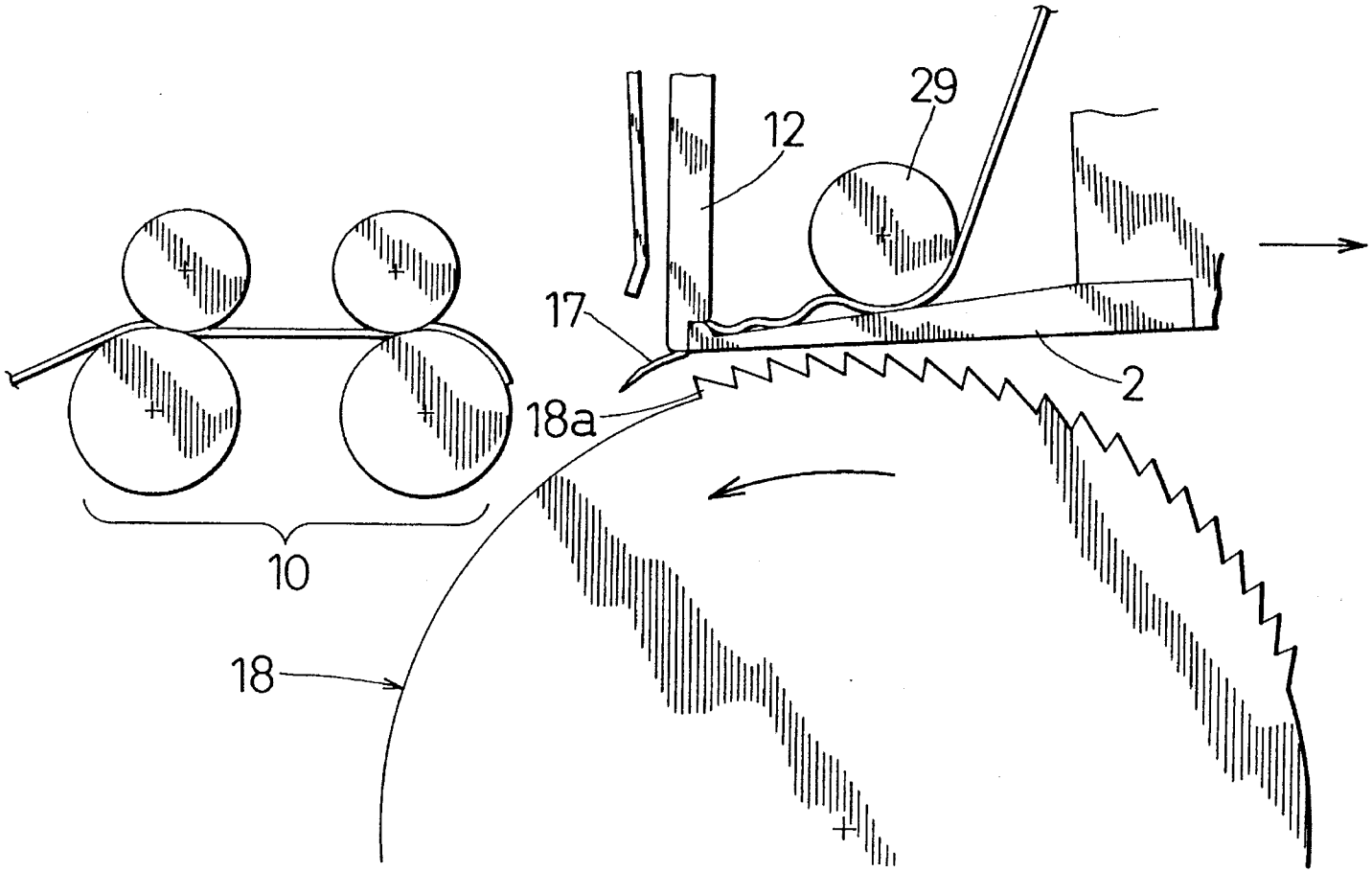
FIG. 5 is an enlarged view of the essential portion of FIG. 2.
Figure 6:
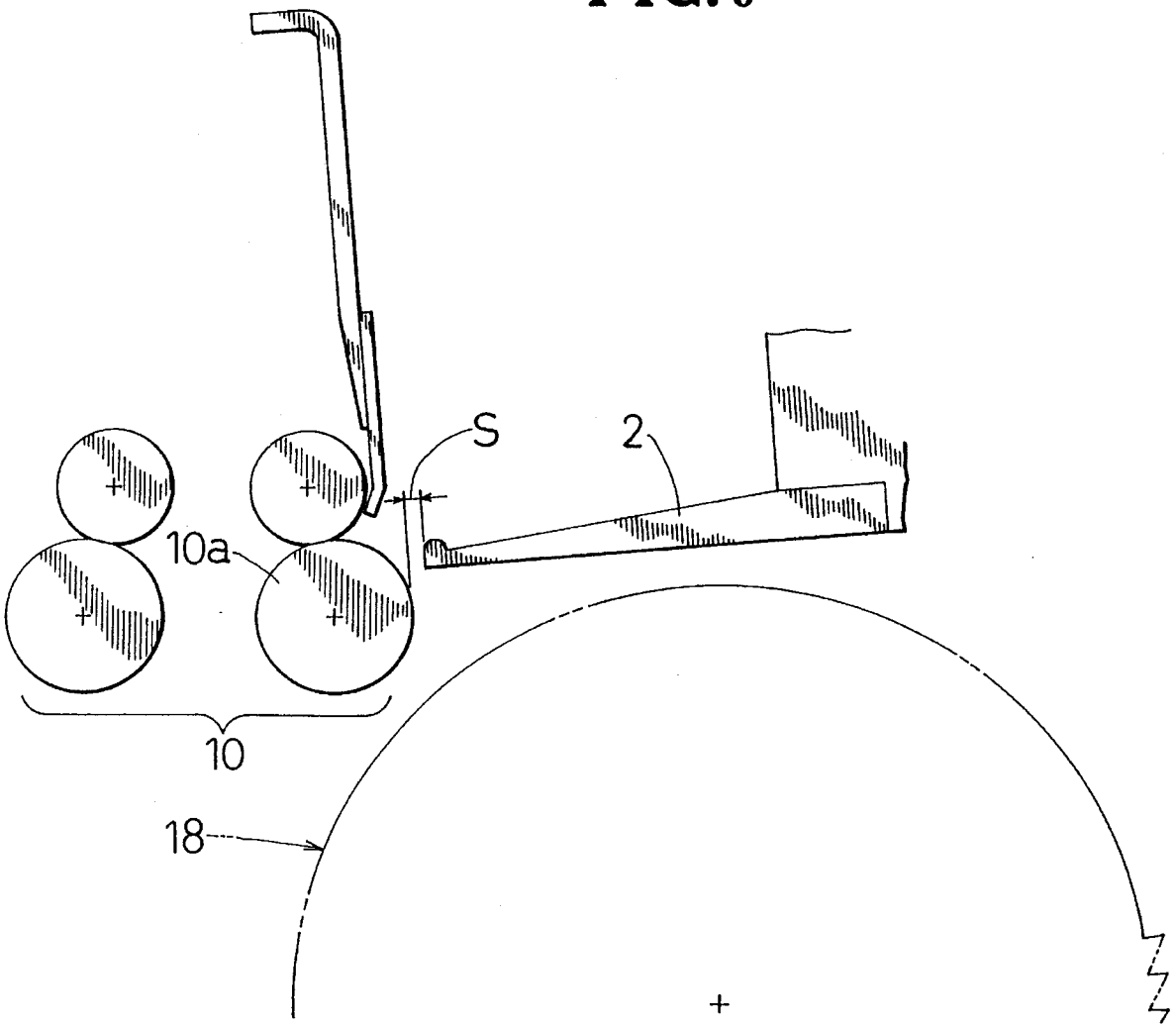
FIG. 6 is a view aiding in describing the nipper gauge.

In FIGS. 1 and 4, reference numeral 32 denotes a dog screwed onto a portion which is extended downward beyond the spring end portion 14*a* of the spring rod 14. During replacement of the feed roller 29, if the nipper knife 12 is lifted beyond a dead point, the nipper knife 12 will become unable to move down. In that case, the dog 32 is used to actuate a limit switch 33 attached to the spring end bracket 22 to stop the entire machine, thereby assuring the safety of the nipper apparatus.

What is claimed is:

1. A nipper apparatus for use in a comber comprising a nipper frame having a cushion plate fixed to a lower portion of the frame, said nipper frame being suspended as a whole by a nipper pivot and a nipper shaft and being arranged to swing toward and away from a detaching roller by a reciprocating turn of said nipper shaft, said nipper apparatus being arranged to repeat gripping and releasing of a fleece on said cushion plate by means of a nipper knife through motion of a nipper arm having said nipper knife at a front end thereof and a spring rod at a rear end thereof which turn according to a swing of said nipper frame, in which a spring end portion of said spring rod which serves as a point for providing pressure support for said nipper arm is pivotally movable supported with respect to a machine frame, said spring end portion being movable along an arc to a predetermined position according to a change in a nipper gauge and fixable in that position.

2. A nipper apparatus for use in a comber according to claim 1, wherein a spring end bracket is pivotally and fixably supported on said machine frame and said spring end portion of said spring rod is pivotally supported on said spring end bracket, a fixing position of said spring end bracket being changable with respect to said machine frame according to a change in a nipper gauge.

3. A nipper apparatus for use in a comber according to claim 2, wherein said spring end bracket has a plurality of pinholes and the fixing position of said spring end bracket is changable with respect to said machine frame by inserting a pin into one of said plurality of pinholes.

* * * * *